US008677516B2

(12) United States Patent
Prendergast

(10) Patent No.: US 8,677,516 B2
(45) Date of Patent: Mar. 25, 2014

(54) HELMET BRACKET

(75) Inventor: Jonathon R. Prendergast, Newport Beach, CA (US)

(73) Assignee: Norots, Inc., Santa Ana, CA (US)

( * ) Notice: Subject to any disclaimer, the term of this patent is extended or adjusted under 35 U.S.C. 154(b) by 1326 days.

(21) Appl. No.: 11/859,689

(22) Filed: Sep. 21, 2007

(65) Prior Publication Data

US 2009/0077721 A1 Mar. 26, 2009

(51) Int. Cl.
*A42B 3/04* (2006.01)

(52) U.S. Cl.
USPC ..... 2/422; 2/426; 248/674; 359/409

(58) Field of Classification Search
USPC ..... 2/422, 426, 6.6; 248/637–638, 664, 248/674; 359/409
See application file for complete search history.

(56) References Cited

U.S. PATENT DOCUMENTS 6,472,776 B1 * 10/2002 Soto et al. ..... 307/400
6,751,810 B1 * 6/2004 Prendergast ..... 2/422
7,219,370 B1 * 5/2007 Teetzel et al. ..... 2/6.2

OTHER PUBLICATIONS

LFK, Front Bracket Assembly, Dwg. No. A3256371, Interface Control Drawing, Feb. 12, 1999, 1 page, U.S. Army Communications—Electronic Command, Fort Monmouth, New Jersey.

* cited by examiner

*Primary Examiner* — Christopher Harmon
(74) *Attorney, Agent, or Firm* — Christie, Parker & Hale, LLP

(57) ABSTRACT

A headgear bracket for mounting night vision goggles includes a base having a fastener recess and a fastener opening within the fastener recess, the fastener opening having a beveled perimeter. A fastener is insertable into the fastener opening, the fastener including a head, a tapered neck extending from the head, and a body extending from the neck. When the fastener is inserted into the opening, the tapered neck abuts the beveled perimeter of the fastener opening.

20 Claims, 12 Drawing Sheets

HELMET BRACKET

FIELD OF THE INVENTION

This invention in one or more embodiments relates to a headgear bracket, and more particularly to a helmet bracket for a mount for night vision goggles.

BACKGROUND OF THE INVENTION

Night vision goggles are commonly used by military personnel for conducting operations in low light or night conditions. Assemblies for mounting night vision goggles to a helmet or other headgear are well known in the art. These mounting assemblies allow a user's hands to remain free while viewing a scene through the night vision goggles.

The headgear worn by military personnel is designed for combat and is able to prevent a bullet shot from a pistol, such as a 9 mm, a 0.357 Magnum or an MP5 submachine gun, shrapnel, and other non-ballistic material from penetrating the headgear. However, when bullets, shrapnel or other material that would ordinarily be stopped and/or sufficiently contained by the headgear encounter an opening in the helmet or the mounting bracket attachment means inserted through such opening, the force of the bullet impacts the weakened structural integrity of the headgear caused by the opening. As such, the bullet or fragment may penetrate the headgear and/or the attachment means may be pushed through the headgear and potentially into the wearer's head, posing serious danger to the wearer. It is desired to have a contoured headgear bracket capable of preventing a bullet from penetrating the headgear and capable of preventing a mounting bracket attachment means from further penetrating the headgear and into a wearer's head.

Moreover, it is generally desirable to provide a means to prevent a bullet or other ammunition from penetrating an opening or other structural weakness created in headgear, thus increasing safety for the headgear wearer.

SUMMARY OF THE INVENTION

A headgear bracket for mounting night vision goggles includes a base having a fastener recess and a fastener opening within the fastener recess, the fastener opening having a beveled perimeter. A fastener is insertable into the fastener opening, the fastener including a head, a tapered neck extending from the head, and a body extending from the neck. When the fastener is inserted into the opening, the tapered neck abuts the beveled perimeter of the fastener opening.

A clip is attachable to a rim of the headgear to further secure the bracket to the headgear. Additionally, the bracket may include a plurality of resilient bumpers, each bumper housed in a bumper recess on the base. An area of the fastener recess may be larger than an area of the head of the fastener. The fastener may be made from a high tensile strength material and may be dimensioned to be prevented from further penetrating the helmet upon impact from a discharged bullet, such as by having a dome-shaped head.

A headgear-facing surface of the fastener recess is configured to conform to a contour of the exterior surface of the headgear and the base may be attachable to headgear by the fastener using a single tool. Further, the bracket is adapted to power enhanced night vision goggles.

DETAILED DESCRIPTION

Figure 1:
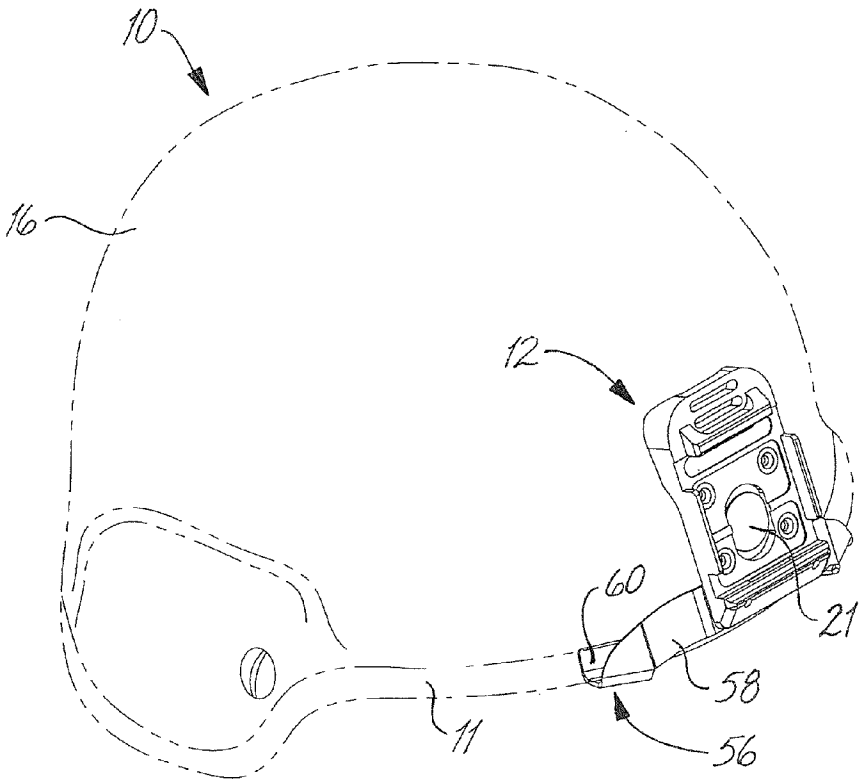
FIG. 1 is an orthogonal view of a helmet bracket assembly attached to a helmet according to an exemplary embodiment of the present invention.
Figure 7:
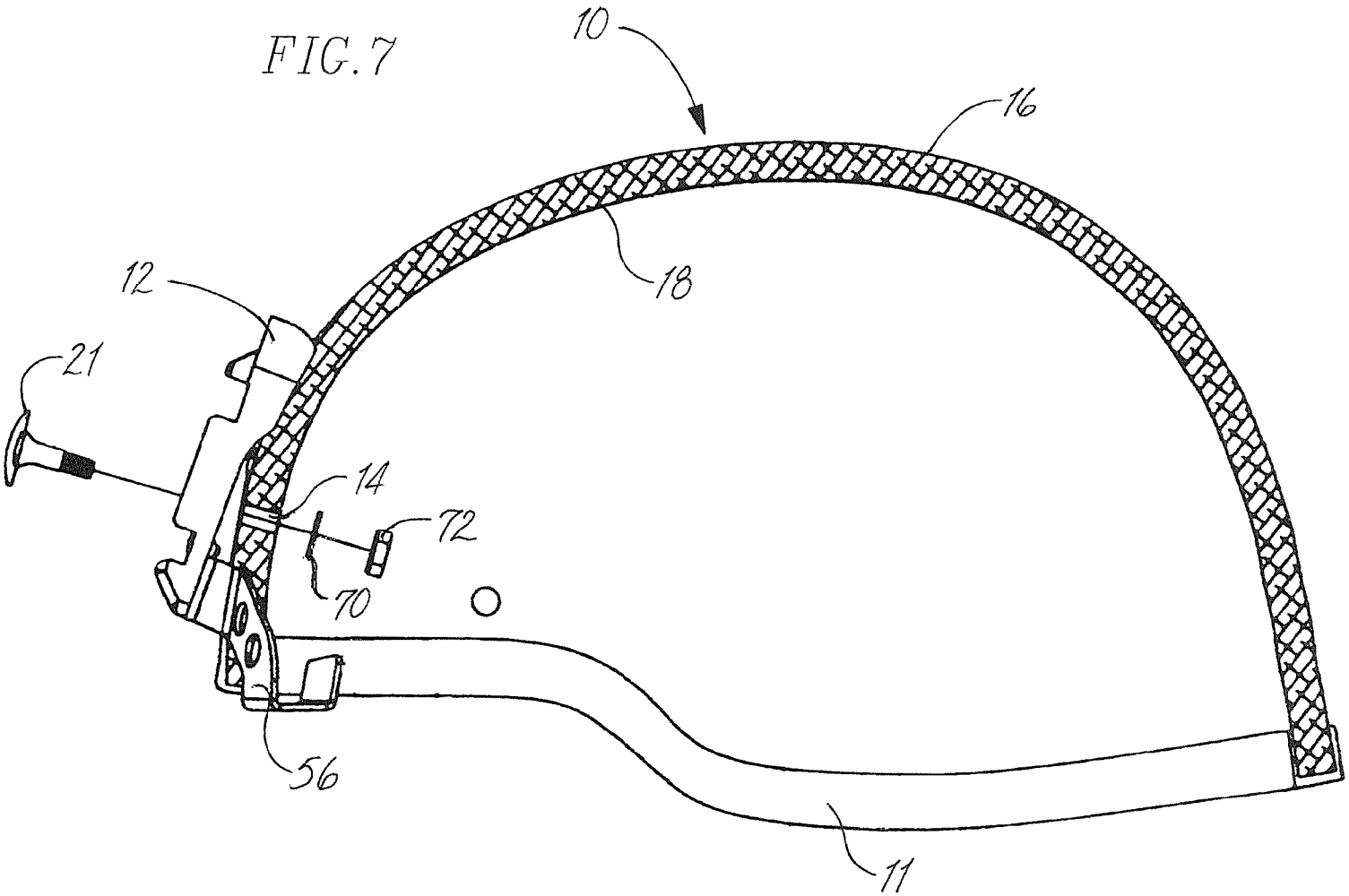
FIG. 7 is a partial cross-sectional exploded side view of the helmet bracket of FIG. 1 as attached to a helmet.

Referring to FIG. 1, headgear such as a helmet 10 is provided and adapted to be mounted with a helmet bracket 12. Although the headgear described herein is a helmet commonly used by military personnel, it is understood that embodiments of the present invention may be incorporated into many different kinds of headgear. The helmet 10 defines an interior cavity shaped generally to conform to a wearer's head. More specifically, as also shown in FIG. 7, the helmet 10 includes an exterior surface 16, interior surface 18, and an opening 14 through which a fastener 21 is insertable to attach the helmet bracket 12 to the helmet 10. The helmet 10 may further include a rim 11 extending along an edge of the helmet. Although the specifically described helmet 10 has only a single opening 14, it will be understood that the number of openings may vary depending on the number of attachment means desired to secure a bracket to the helmet.

Figure 2:
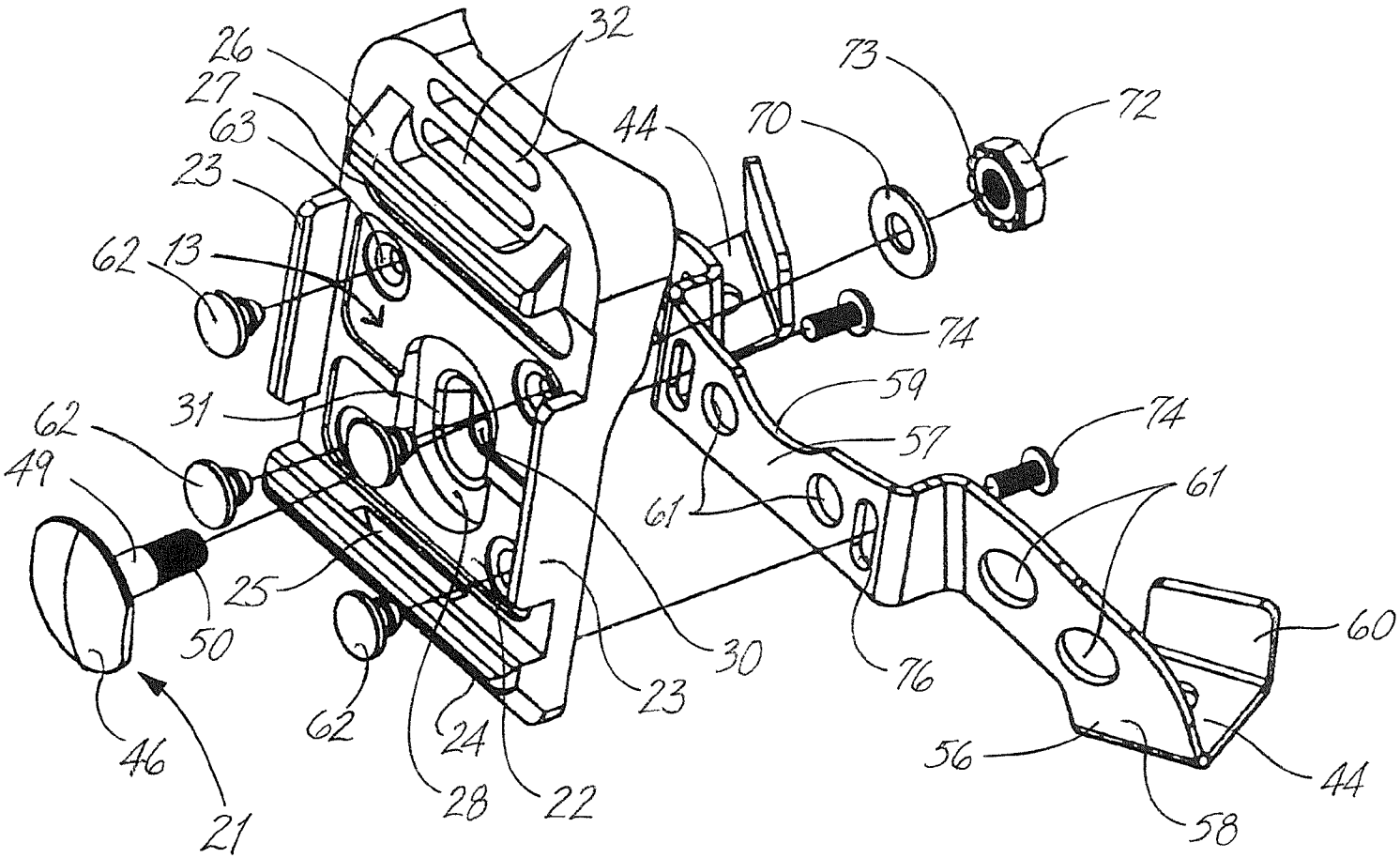
FIG. 2 is an orthogonal exploded view of the helmet bracket assembly of FIG. 1.

With reference now to FIG. 2, a base 13 of the helmet bracket 12 is adapted to receive a lock plate of a night vision goggle helmet mount (not shown). The base 13 of the helmet bracket 12 includes a lock plate receiving area 22 against which a lock plate inserted into the helmet bracket abuts. The helmet bracket further comprises a foot 24 having a lower recess 25 into which a tongue of the lock plate is insertable, and a shoulder 26 including an upper recess 27 into which an upper lip of the lock plate snaps to secure the lock plate to the helmet bracket 12.

As noted above, the lock plate receiving area 22 is dimensioned to receive a lock plate from night vision goggles, and comprises two side flanges 23 to additionally secure the lock plate against rotation or from being otherwise displaced from the receiving area 22. The lock plate receiving area 22 further includes an opening 30 adapted to receive a fastener 20 and a fastener recess 28 to permit the fastener to be flush with or recessed from the receiving area. Accordingly, a fastener, such as a ballistic bolt 21, inserted into the opening 30 will not interfere with a lock plate attached to the receiving area 22. In one exemplary embodiment, the fastener recess 28 has a flat surface 29 against which a portion of the fastener 20 abuts, as described in more detail below. Further, the opening 30 of the fastener recess 28 may comprise a beveled perimeter 31 to accommodate a tapered neck 48 of the fastener 20. In one exemplary embodiment, the opening 30 may have an area greater than a diameter of the helmet opening 14 (FIG. 7) to permit positional adjustment of the bracket 12 with respect to the helmet. For example, the bracket opening 30 may be substantially oval to permit adjustable vertical positioning of the helmet bracket 12 with respect to the helmet. In exemplary embodiments, the opening 30 allows for vertical adjustment of no less than about 0.3 inch.

The lock plate receiving area 22 may further comprise a plurality of recessed bumper openings 63, each bumper opening adapted to receive a bumper 62. A single bumper 62 may be secured into each bumper opening 63 to dampen noise resulting from the loading of a lock plate onto the bracket 12, and to preload the bracket for insertion of the lock plate. In one exemplary embodiment, the lock plate receiving area 22 comprises four bumper openings 63, but one of ordinary skill in the art will appreciate that more or fewer bumper openings in a variety of configurations may be used without departing from the spirit and the scope of the present invention.

The helmet bracket 12 further contains a pair of strap or cable openings 32 above the shoulder 26 through which a strap or cable may be inserted to connect the helmet bracket to a hot shoe and/or to more securely attach the helmet bracket 12 to the helmet 10, as described in more detail below. Moreover, a clip 56 may be attached to the helmet bracket 12 to provide additional security against rotation of the helmet bracket 12 when the bracket is attached to a helmet 10. The clip 56 may comprise a front plate 57 and a pair of arms 58 extending from the front plate, each arm having a generally U-shaped hand portion 60 which fits over the rim 11 of the helmet 10. The front plate 57 may comprise a notch 59 to prevent interference with the ballistic bolt 21 inserted through the opening 30 of the bracket 12 with the clip 56. Additionally, the front plate 57 may comprise a plurality of slots 76 through which a clip fastener 74, such as a screw, may be inserted and secured to clip fastener holes 78 on the bracket (FIG. 3) to attach the clip 56 to the bracket 12. A length of the slot 76 may be greater than a diameter of the clip fastener 74 such that the clip 56 may be adjusted vertically with respect to the bracket 12. Additionally, the clip 56 may include holes 61 which reduce the weight of the clip without compromising the structural integrity. The clip fastener 74 is designed to be compatible with the standard military-issued Gerber tool 27550G to allow for assembly and adjustment by the user at anytime or location. Although a helmet bracket adapted to receive a lock plate of a night vision goggles mounting device is described herein, one of ordinary skill in the art will appreciate that other types of brackets and mounting devices may be used in conjunction with embodiments of the present invention without departing from the spirit and the scope of the invention.

With reference again to FIG. 2, a kep nut 72 is provided to be threaded to a threaded tip 50 or shaft of the ballistic bolt 21. The kep nut 72 comprises teeth 73 which engage an adjacent surface to provide additional resistance to rotation when the kep nut 72 has been secured to the ballistic bolt 21. A washer 70 may be inserted between the kep nut 72 and the helmet 10 so that the teeth 73 of the kep nut engage the washer and do not damage the structural integrity of the helmet. In one exemplary embodiment, the washer may comprise nylon, or any other material which will sufficiently engage the teeth 73 of the kep nut 72. Further, in one exemplary embodiment, the kep nut 72 is compatible with the standard military-issued Gerber tool 27550G to allow for assembly and adjustment by the user at anytime or location.

Figure 4:
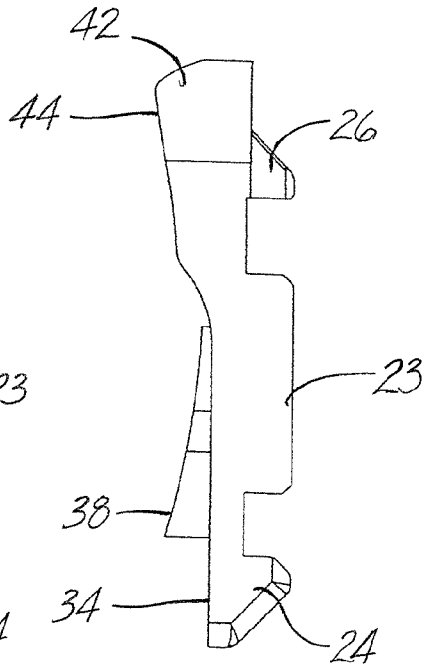
FIGS. 3 and 4 are an orthogonal rear view and a side view, respectively, of the helmet bracket of FIG. 1.
Figure 3:
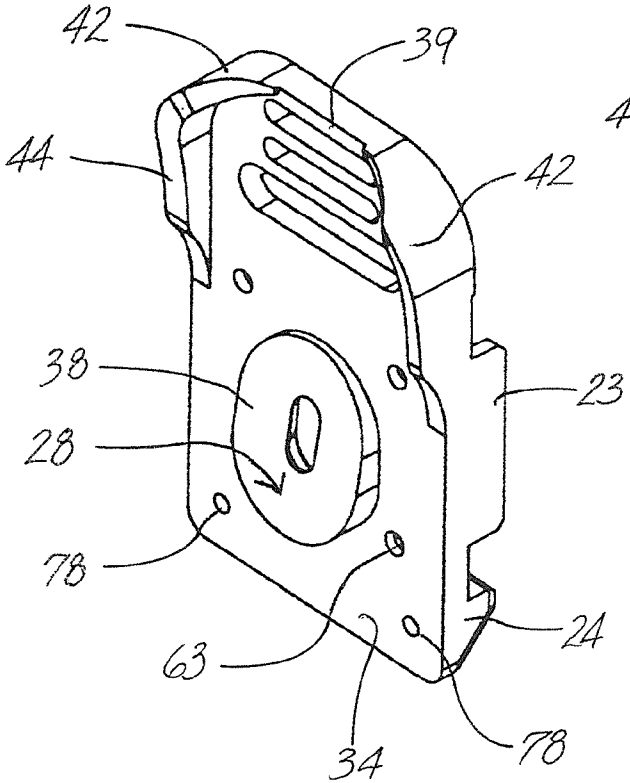

Referring now to FIGS. 3 and 4, the fastener recess 28 protrudes from a helmet-facing surface 34 of the helmet bracket 12. In one exemplary embodiment, a recess contact surface 38 surrounds the opening 30 in the fastener recess 28 and a curvature of the fastener recess substantially matches the contour of the exterior surface 16 of the helmet 10 (FIG. 1). By matching the contour of the exterior surface 16 of the helmet 10, the recess distributes force along the helmet surface rather than absorbing the entire impact of a bullet. More specifically, the curvature of this surface may be achieved by having a height of the fastener recess 28 nearer the foot 24 of the helmet bracket 12 greater than the height of the fastener recess nearer the shoulder 26 to account for the curvature of the helmet 10. For example, a height of the fastener recess 28 may be about 0.1 inch at a first end and about 0.2 inch at a second end. However, a specific height of the fastener recess 28 is not critical, but rather the helmet-facing surface of the fastener recess should have a geometry such that the recess contact surface 38 makes substantial contact with an exterior surface 16 of the helmet 10.

A pair of support flanges 42 protrude from the helmet-facing surface 34 around a perimeter of the helmet facing surface 34 proximal the cable openings 32 to provide additional contact between the helmet bracket 12 and the helmet 10. The support flanges 42 include a flange contact portion 44 shaped to substantially match the contour of the helmet 10 to ensure greater contact between the helmet bracket 12 and the helmet. The support flanges 42 provide additional resistance to prevent a bullet from penetrating the helmet bracket opening 30 by absorbing the impact of the bullet and dispersing the energy of the impact over the surface of the helmet 10. Further, the support flanges 42 provide greater resistance to rotation and may prevent a portion of the helmet bracket 12 from fracturing due to force applied to a top half of the bracket. As shown in FIG. 3, the support flanges 42 taper back toward the helmet-facing surface 34 of the helmet bracket 12 at the top of the bracket to create a notch 39 through which a strap or cable attached to the helmet bracket can extend.

Figure 5B:
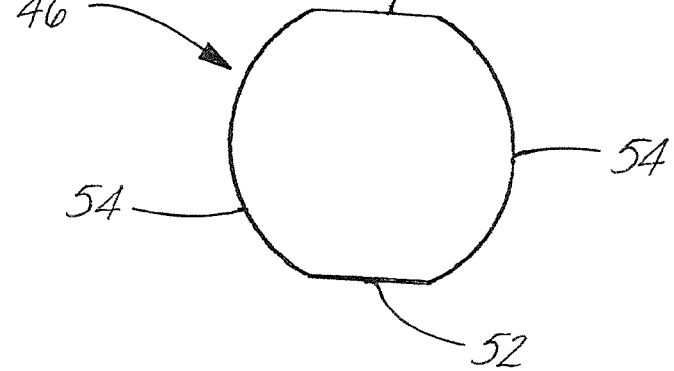
FIG. 5*b* is a top view of the faster of FIG. 5*a* taken along the line A-$A_1$.
Figure 5A:
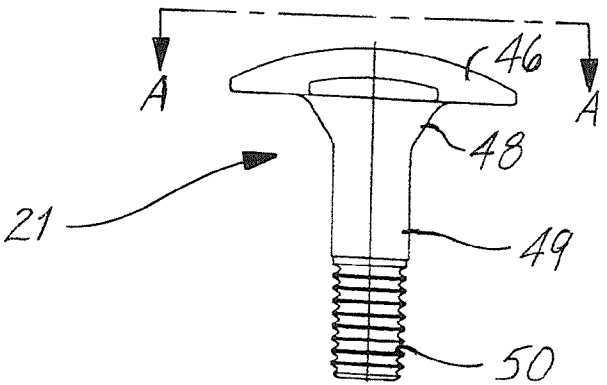
FIG. 5*a* a side view of an exemplary embodiment of a fastener of the present invention.

With reference now also to FIGS. 5*a* and 5*b*, the ballistic bolt 21 according to an exemplary embodiment of the present invention is insertable through the opening 30 to securely attach the bracket 12 to a helmet 10. In general, a geometry of the ballistic bolt 21 is designed to prevent the bolt from further penetrating the helmet upon impact by a discharged bullet and, accordingly, to remain as a single component rather than shearing into two sections at a head/neck junction. More specifically, a profile of the ballistic bolt is designed to maximize distribution of a direct or indirect ballistic impact, yet having a minimum height to allow reverse compatibility to existing helmet mounts. In one exemplary embodiment, the ballistic bolt 21 comprises a generally dome-shaped head 46, a tapered neck 48 integral with and extending from the head, and an integral body 49 extending from the neck and having a threaded tip 50. The dome-shape of head 46 is configured to deflect a bullet sideways on impact, thereby reducing the force of the bullet perpendicular to a longitudinal axis of the ballistic bolt 21 and to prevent fracture or bending of the head. In one exemplary embodiment, a minimum thickness of the thickest portion of the head 46 is about 0.1 inch In one exemplary embodiment, the head 46 has a radial cross-sectional area of at least about 0.4 inch such that enough area is provided to prevent the bullet and/or the bolt from penetrating the helmet 10. However, as one of ordinary skill in the art will appreciate, many differently sized bolts may be used without departing from the spirit and scope of the present invention.

As shown in FIG. 5*b*, the head 46 may have a generally oval radial cross-section with straight perimeter sections 52 opposite one another and separated from one another by curved perimeter sections 54. The straight perimeter sections 52 are adapted to abut the straight perimeter section of the fastener recess 28 to prevent rotation of the ballistic bolt 21 after the bolt has been fastened against the bracket 12 as described in more detail below. Additionally, with reference to FIG. 5*a*, the tapered neck 48 provides increased structural integrity to the ballistic bolt 21 and greater surface area contact between the ballistic bolt and the bracket 12 when the bolt is inserted into the opening 30. Thus, greater load distribution is provided on impact and a likelihood that the ballistic bolt will shear at a head/neck junction, which may cause the body 49 to penetrate a user's helmet, is reduced. The body 49 extends integrally from the neck 48 and has a threaded tip 50 for receiving a nut, such as a kep nut 72 (FIG. 2). In one exemplary embodiment, the ballistic bolt 21 comprises heat treated stainless steel such as 17-4 stainless steel, 300 series stainless steel, titanium, or various alloys or other combinations of metals. However, it will be understood by those of ordinary skill in the art that any sufficiently rigid or high tensile strength material may be used for the ballistic bolt 21. For example, certain bullet resistant composite or woven materials may be used.

Figure 6:
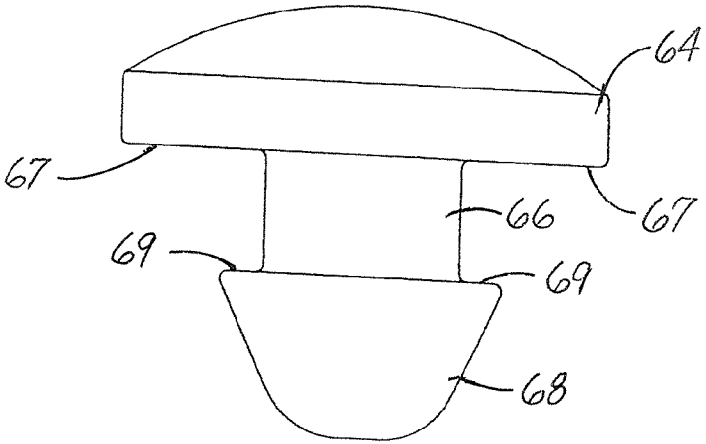
FIG. 6 is a side view of a bumper of the present invention.

With reference now to FIG. 6, each bumper 62 comprises a head 64, an integral body 66 extending from the head, and a tip 68 extending from the body. Both the head 64 and the tip 68 may have a maximum diameter greater than a maximum diameter of the body 66 to create shoulders 67, 69 between the head and the body and the tip and the body, respectively. In one exemplary embodiment, the bumpers 62 are made from a relatively elastic material, such as high strength rubber. Specifically, the bumpers 62 may comprise ethylene propylene diene monomer (EPDM) rubber, silicone, or other similar materials. With reference also to FIG. 2, each bumper 62 is inserted into the recessed bumper opening 63 in the lock plate receiving area 22 such that the shoulders 67, 69 abut opposite surfaces of the base 13. The openings 63 are recessed such that the head 64 of the bumper 62 slightly protrudes from the lock plate receiving area surface to allow for preloading and to muffle noise generated by insertion of a lock plate.

With reference now to FIGS. 2 and 7, the helmet bracket 12 may be attached to the helmet 10 as follows. Clip fasteners 74 may be inserted through the slots 76 on the clip 56 and into the clip fastener holes 78 on the bracket 12 to attach the clip to the bracket. Alternately, the clip 56 may be integral with the bracket 12, or the bracket may be used without the clip at all. The hand portions 60 of the clip 56 may then be placed onto the rim 11 of the helmet 10, and the flange contact surface 44 may be rested against the exterior surface 16 of the helmet. The ballistic bolt 21 is inserted through the openings 30, 14 of the helmet bracket 12 and the helmet 10, respectively, and secured in place by, for example, the kep nut 72. The bolt 21 is prevented from unintended rotation by the straight perimeter sections 52 abutting a side of the fastener recess 28 and the bolt 21 requires only a single tool to attach it to the helmet 10. Specifically, the bolt 21 may be attached by tightening the kep nut 72 with pliers found on a standard issue Gerber multi-use tool 27550G, or other similar tools, commonly carried by soldiers in the field and does not require two tools, i.e., one to hold the bolt and one to tighten the nut 72. As will be understood by those of skill in the art, the fastener is not limited to being a bolt and kep nut, but may also be, for example, a rivet, or another type of fastener attached by an adhesive, or the like.

When used to attach the bracket 12 to a helmet 10, the head 46 of the ballistic bolt 21 impacted by a discharged bullet will bear the force of impact and distribute such force along the bracket 12 and the surface of the helmet. Accordingly, the ballistic bolt 21 and the bullet will be prevented from further penetrating the helmet, and more importantly, will not penetrate the wearer's head.

Figure 8:
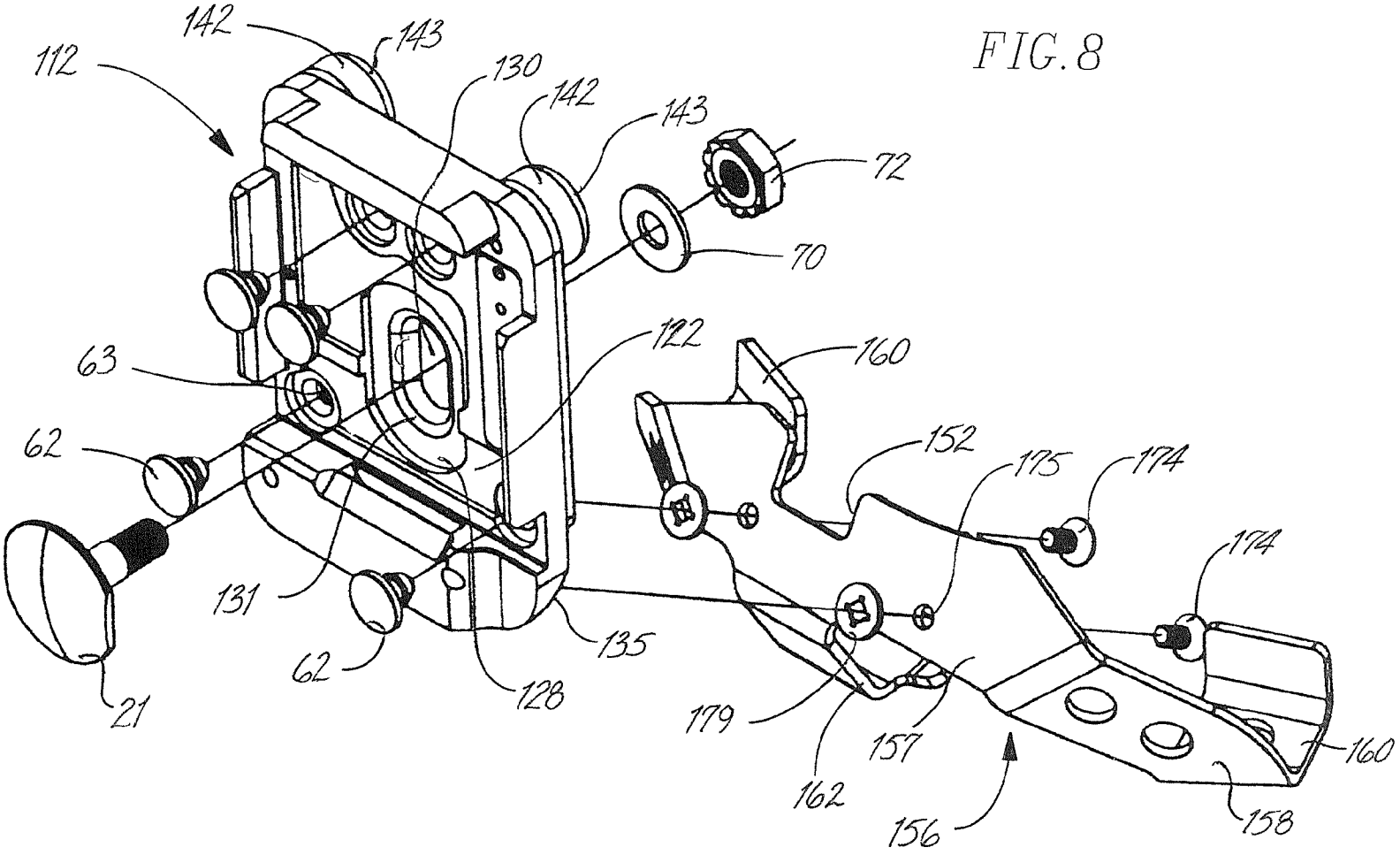
FIG. 8 is an orthogonal exploded view of an alternate embodiment of a helmet bracket assembly of the present invention.
Figure 9:
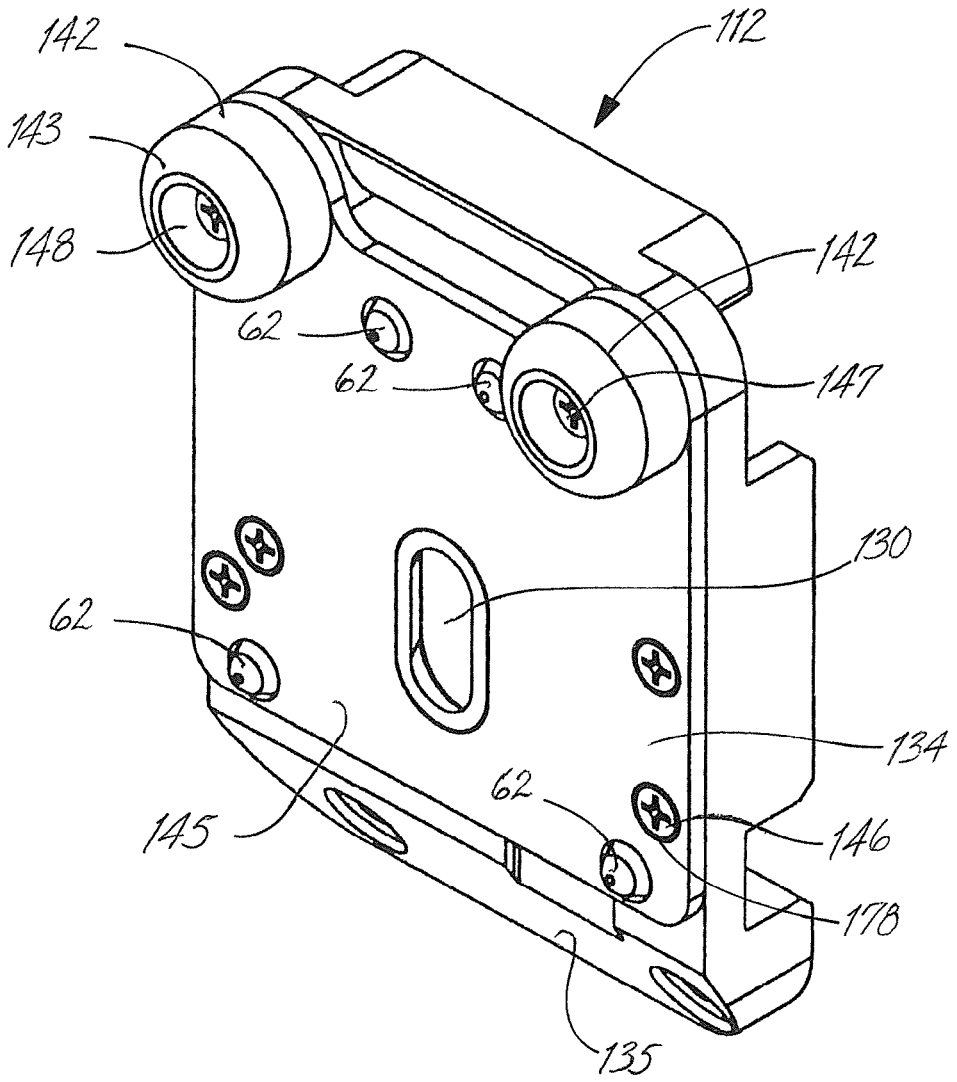
FIG. 9 is an orthogonal rear view of the helmet bracket of FIG. 8.
Figure 10:
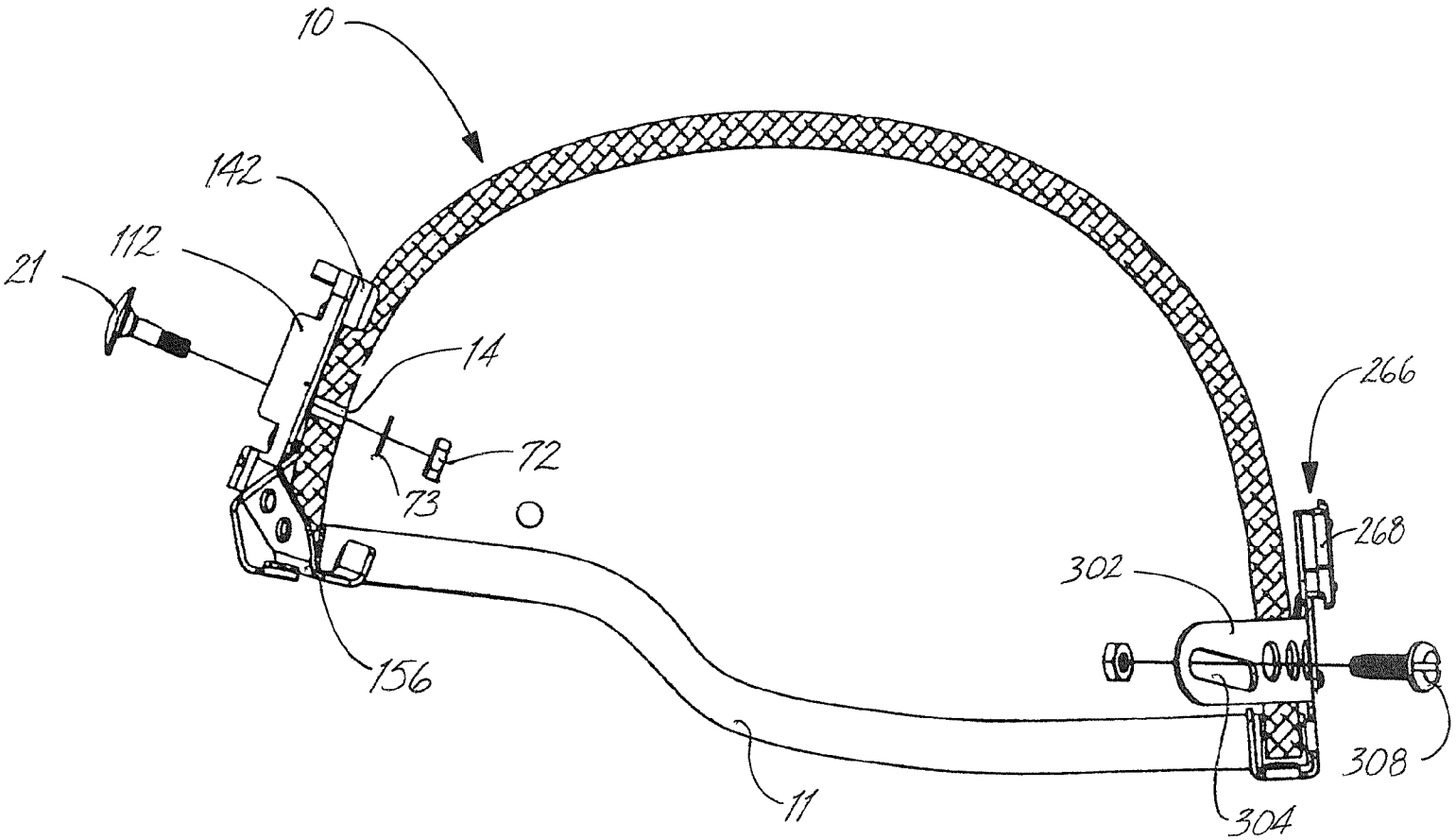
FIG. 10 is a partial cross-sectional exploded side view of the helmet bracket of FIG. 8 attached to a helmet.

With reference now to FIGS. 8-10, in an alternate embodiment of the present invention, the ballistic bolt 21 may be used in conjunction with an enhanced night vision goggle (ENVG) bracket 112 which comprises electrical circuitry for powering the ENVG. The compatibility of the ballistic bolt 21 with brackets 12 and 112 facilitates ensuring a proper ballistic bolt is matched with a respective bracket, and simplifies replacement of bolts and/or brackets in the field.

With reference now to FIG. 8, the bracket 112 comprises a lock plate receiving area 122 having a fastener recess 128 and an opening 130 with a beveled perimeter 131. The fastener recess 128 is dimensioned to receive the head 46 of the ballistic bolt 21, with the body 49 insertable through the opening 131 and the neck 48 abutting the beveled perimeter 131. A clip 156 is attachable to a helmet-facing surface 134 to provide additional resistance to rotation for the bracket 112. The clip 156 comprises a front plate 157 angled to match an angled surface 135 of the bracket 112 and having a notch 152 to prevent the front plate from interfering with a fastener 21 inserted through the opening 130 in the bracket 112. Two lateral arms 158 extending from the front plate 157 having hands 160 engageable around the rim 11 of the helmet 10. Additionally, a central hand 162 extends from the front plate 157 also engageable with the rim 11 of the helmet. Clip fasteners 174 are insertable through slots 175 and into fastener holes 178 on the helmet facing surface 134 of the bracket 112 to attach the clip 156 to the bracket. A washer 179 may be inserted between the clip 156 and the bracket 112. As will be appreciated by one of ordinary skill in the art, the clip 156 may be integral with the bracket 112 or the bracket may be used without the clip.

With reference also now to FIG. 9, a back plate 145 covers circuitry on the bracket 112, the back plate being attached by fasteners 146. A pair of resilient feet 142 protrude from the back plate 145 at an upper portion of the helmet-facing surface 134 to provide additional contact between the helmet bracket 112 and the helmet 110. The resilient feet 142 each comprise a cylindrical member having a beveled edge 143 surrounding an attachment recess 148, which allows a fastener 147 attaching the feet 142 to the bracket 112 to be recessed from a helmet-contact surface of each foot. The resilient feet 143 provide additional resistance to prevent a bullet from penetrating the helmet bracket opening 130 by absorbing the impact of the bullet and dispersing the energy of the impact over the surface of the helmet 110. Further, the resilient feet 143 provide greater resistance to rotation and may prevent a portion of the helmet bracket 112 from fracturing due to force applied to a top half of the bracket. As will be appreciated, the feet 142 may be attached to the bracket 112 by any sufficient means, such as adhesive, a rivet, or the like.

Similarly to previously described embodiments, after the clip 156 has been placed around the rim 11 of the helmet and the ballistic bolt 21 has been inserted into the fastener recess 128 and through the openings 130, 14 of the bracket 112 and helmet, the kep nut 72 may be threaded to the threaded tip 50 to secure the bracket to the helmet. As noted above, the bracket 112 may also be attached without the clip 156.

Figure 11:
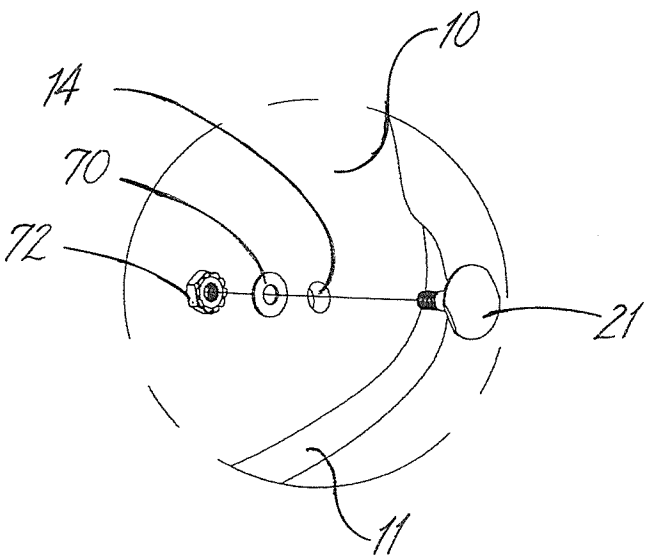
FIG. 11 is an exploded view of a fastener attached directly to a helmet according to an exemplary embodiment of the present invention.
Figure 12:
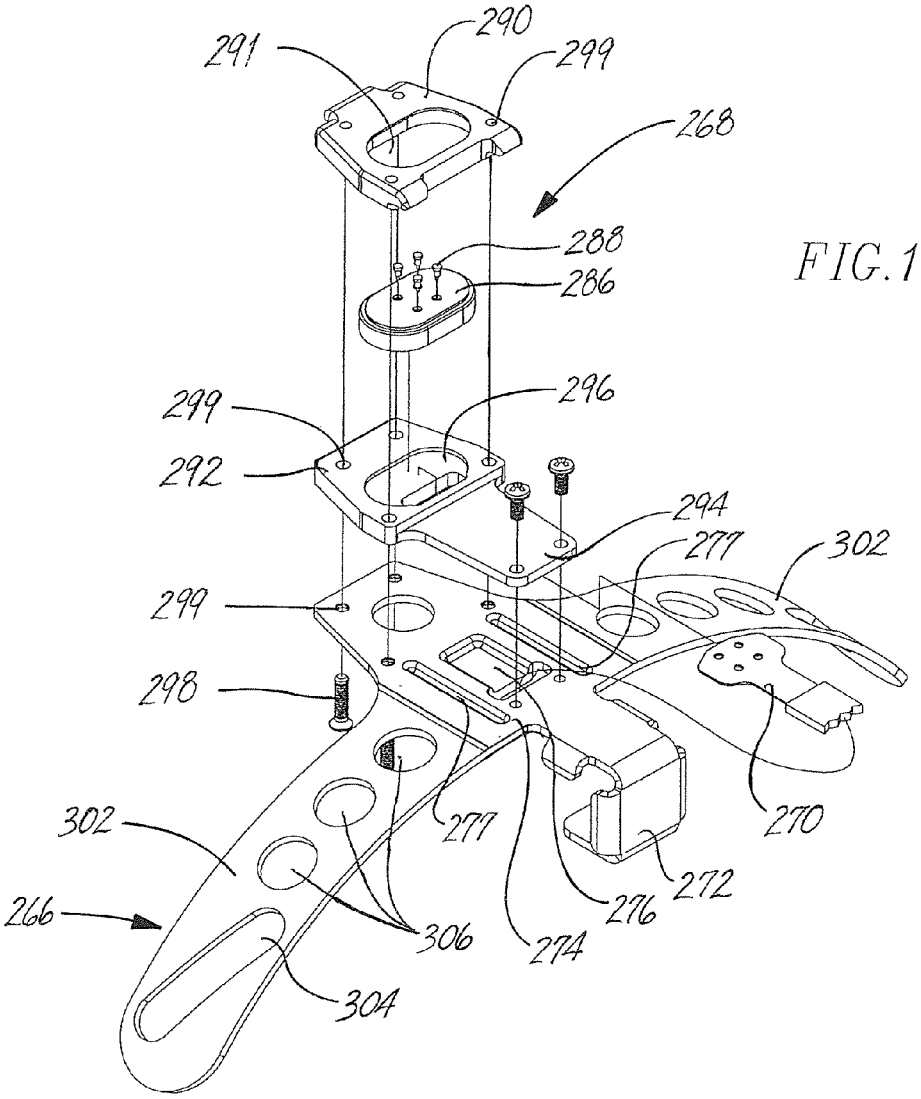
FIGS. 12, 13, and 14 are an exploded view, a side view, and a front view, respectively, of a hot shoe bracket in accordance with exemplary embodiments of the present invention.

In an alternate embodiment of the present invention, as shown in FIG. 11, the ballistic bolt 21 may be attached directly to the helmet 10 by a kep nut 72 without an accompanying helmet bracket 12. As such, the ballistic bolt will prevent a bullet from piercing the opening 14 in the helmet 10 even when a helmet bracket 12 is not mounted to the helmet. Additionally, the ballistic bolt 21 may be used with various other types of mounting devices or other headgear components to reinforce a structurally vulnerable area. One of ordinary skill in the art will also appreciate that the ballistic bolt 21 may be used with a helmet bracket 12 or other mounting device even if the ballistic bolt 21 is separately attached to the helmet 10.

With reference now to FIGS. 10 and 12-16, the helmet 10 may be adapted to receive a hot shoe bracket assembly 266. With reference to FIGS. 12-16, a hot shoe bracket 266 is provided to attach a hot shoe assembly 268 to a helmet 10. The hot shoe assembly 268 is, in one exemplary embodiment, dove-tailed shaped and is adapted to provide an electrical connection between a battery pack (not shown) and a night vision goggles mount (not shown) through a cable 270 (FIG. 16) and the helmet bracket 12.

The hot shoe bracket 266 may comprise a foot 272 having a substantially U-shaped cross-section adapted to secure the hot shoe bracket 266 to the helmet rim 11. The bracket base 274 comprises a recess 276 to provide additional structural support and to house the cable 270 and a pair of channels 277 to provide additional structural support. One of ordinary skill in the art will appreciate that channels of various configurations of channels may be used.

A block insulator 286 comprising a plurality of contacts 288 and secured by a hot shoe cover 290 having a block insulator opening 291 may abut the bracket base 274 and be secured within a support plate opening 296. In one exemplary embodiment, the contacts 288 are electrically connected to the cable 270 which extends to the helmet bracket 12.

A support plate 292 may be attached between the hot shoe bracket 266 and the hot shoe cover 290, the support plate having a tail section 294 extending along a portion of the bracket base 274. The support plate 292 may include the hot shoe opening 296 corresponding to the opening 291 on the hot shoe cover 290 in which the block insulator 286 is housed. Hot shoe fasteners 298, such as screws, may be inserted through attachment holes 299 in the hot shoe cover 290, support plate 292 and hot shoe bracket 266 to attach the components together. In one exemplary embodiment, the support plate 292 comprises a relatively lightweight material, such as plastic or aluminum. In one exemplary embodiment, the thickness of the support plate 292 is at least about 0.06 inch.

Figure 14:
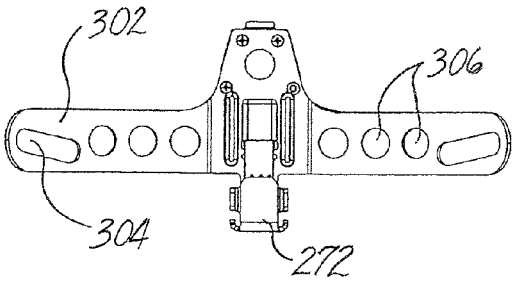
Figure 16:
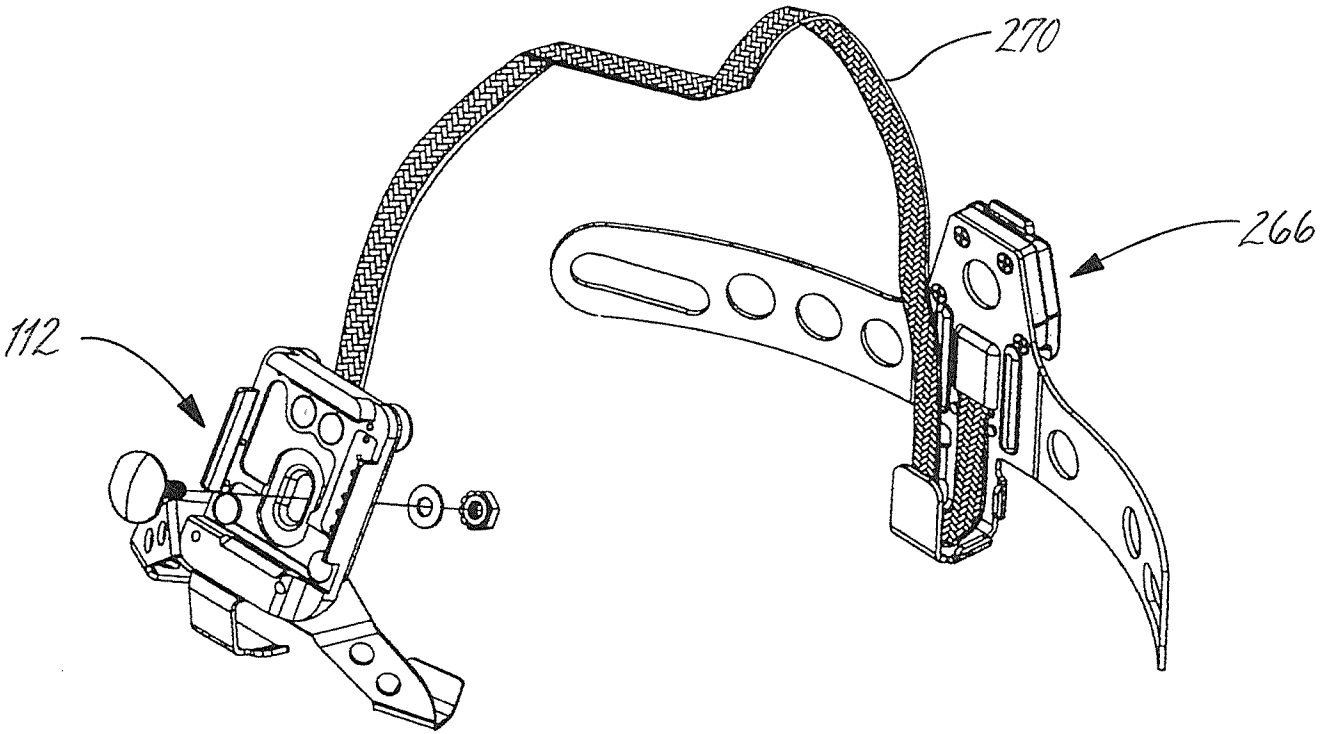
FIG. 16 is an orthogonal view of a helmet bracket attached to a hot shoe bracket by a cable according to an exemplary embodiment of the invention.

The hot shoe bracket 266 further comprises a pair of arms 302 extending from the bracket base 274 to secure the hot shoe bracket to a helmet 10. In one exemplary embodiment, the arms 302 may be curved to substantially match a contour of the helmet 10 and the arms may be integral with the bracket base 274 or they may be manufactured separately and attached by, for example, welding. Each arm 302 comprises an attachment opening 304 and may further include a plurality of holes 306 which reduce the weight of the hot shoe bracket 266. In one exemplary embodiment, each arm 302 is of a sufficient length such that the attachment opening 304 may be aligned with pre-drilled holes 310 in any of the differently sized standard issue combat MICH/ACH helmets issued by the U.S. military, the pre-drilled holes being used to attach other components, for example, a chin strap. Accordingly, the attachment openings 304 may be ovular and angled slightly with respect to a longitudinal axis of each arm 302 as shown in FIG. 14. By being attachable to pre-drilled holes 310, additional holes for mounting the hot shoe bracket 266 are not necessary, saving drilling cost and time, and preventing another vulnerable location from being created on the helmet 10.

Figure 15:
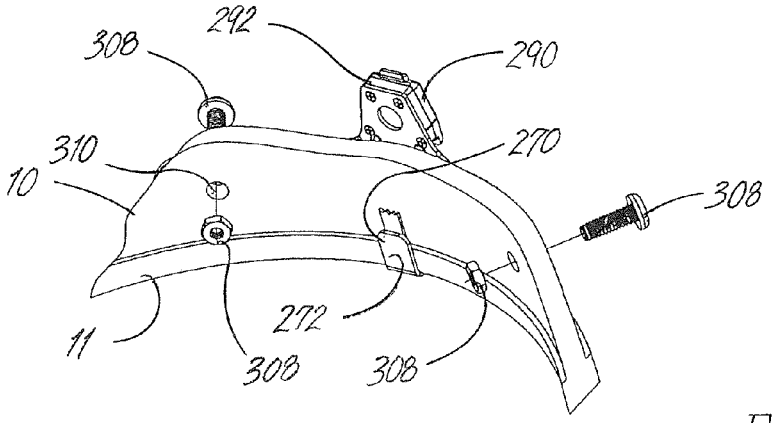
FIG. 15 is a cutaway partially exploded view of a hot shoe bracket assembly in accordance with exemplary embodiments of the present invention attached to a helmet.
Figure 13:
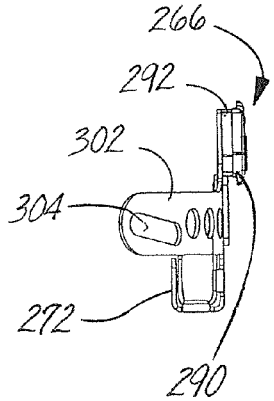

With reference to FIG. 15, after the foot 272 has been engaged over the rim 11 of the helmet 10, a fastener 308, such as a nut and bolt, may be inserted through the attachment openings 304 and pre-drilled holes 310 to attach the hot shoe bracket 266 to the helmet 10. As will be apparent to one of ordinary skill in the art, holes specifically for attaching the hot shoe bracket 266 may be drilled into the helmet 10, if desired. As shown in FIG. 15, the cable 270 may be used to electrically connect the hot shoe bracket 266 to the helmet bracket 12.

Although the present invention has been described through the use of exemplary embodiments, it will be appreciated by those of skill in the art that various modifications may be made to the described embodiments that fall within the scope and spirit of the invention as defined by the claims and their equivalents appended hereto.

What is claimed is:

1. A headgear bracket for mounting night vision goggles comprising:

a base comprising a body and a fastener recess, the body comprising a generally flat first surface configured to accommodate a plate and a generally flat second surface opposite to the first surface, wherein the fastener recess protrudes from the second surface and has a headgear-facing surface contoured to conform to at least a portion of an exterior surface of a headgear, and a fastener opening within the fastener recess, the fastener opening having a beveled perimeter; and a fastener insertable into the fastener opening, the fastener comprising:

a head;

a tapered neck extending from the head; and a body extending from the neck;

wherein, when the fastener is inserted into the opening, the tapered neck abuts the beveled perimeter of the fastener opening.

2. The headgear bracket of claim 1, further comprising a clip attachable to a rim of the headgear.

3. The headgear bracket of claim 1, further comprising a plurality of resilient bumpers, each bumper housed in a bumper recess on the base.

4. The headgear bracket of claim 1, wherein an area of the fastener recess is larger than an area of the head of the fastener.

5. The headgear bracket of claim 1, wherein the fastener comprises a high tensile strength material.

6. The headgear bracket of claim 1, wherein the fastener is dimensioned to be prevented from further penetrating the helmet upon impact from a discharged bullet.

7. The headgear bracket of claim 1, wherein the bracket is adapted to power enhanced night vision goggles.

8. The headgear bracket of claim 1, wherein the base is attachable to headgear by the fastener using a single tool.

9. The headgear bracket of claim 1, the fastener further comprising a threaded portion and a nut attachable to the threaded portion.

10. The headgear bracket of claim 9, wherein the nut is a kep nut.

11. The headgear bracket of claim 6, wherein the head of the fastener is domed.

12. A headgear on which night vision goggles are mountable comprising:

a helmet fastener opening; and a bracket comprising:

a body comprising a generally flat first surface configured to accommodate a plate and a generally flat second surface opposite to the first surface; and a fastener recess protruding from the second surface and having a headgear-facing surface contoured to conform to at least a portion of an exterior surface of the headgear and a bracket fastener opening within the fastener recess alignable with the helmet fastener opening, the bracket fastener opening having a beveled perimeter; and a fastener insertable into the helmet fastener opening and the bracket fastener opening comprising:

a head;

a tapered neck extending from the head;

a body extending from the neck;

wherein, when the fastener is inserted into the helmet fastener opening and the bracket fastener opening:

the fastener recess prevents rotation of the fastener; and the tapered neck abuts the beveled perimeter of the fastener opening.

13. The headgear of claim 12, further comprising a clip attachable to a rim of the headgear.

14. The headgear of claim 12, further comprising a plurality of resilient bumpers, each bumper inserted into a bumper recess.

15. The headgear of claim 12, wherein an area of the fastener recess is larger than an area of the head of the fastener.

16. The headgear of claim 12, wherein the fastener is dimensioned to be prevented from further penetrating the headgear upon impact from a discharged bullet.

17. The headgear of claim 12, wherein the bracket is adapted to power enhanced night vision goggles.

18. The headgear of claim 12, wherein the base is attachable to headgear by the fastener using a single tool.

19. The headgear of claim 16, wherein the head of the fastener is dome-shaped.

20. The headgear bracket of claim 5, wherein the high tensile strength material comprises heat-treated stainless steel or titanium.

* * * * *

UNITED STATES PATENT AND TRADEMARK OFFICE

CERTIFICATE OF CORRECTION

PATENT NO. : 8,677,516 B2
APPLICATION NO. : 11/859689
DATED : March 25, 2014
INVENTOR(S) : Jonathon R. Prendergast It is certified that error appears in the above-identified patent and that said Letters Patent is hereby corrected as shown below:

On the Title Page

(73) Assignee: Delete "NOROTS"

Insert -- NOROTOS --

Signed and Sealed this
Eighth Day of September, 2015

Michelle K. Lee

Michelle K. Lee
*Director of the United States Patent and Trademark Office*